United States Patent [19]

Krolzick

[11] Patent Number: 4,905,624

[45] Date of Patent: Mar. 6, 1990

[54] FLAGSTICK POSITION INDICATOR

[76] Inventor: Fred H. Krolzick, 310 W. First St., Mishawaka, Ind. 46544

[21] Appl. No.: 283,494

[22] Filed: Dec. 12, 1988

[51] Int. Cl.[4] ..... G09F 17/00

[52] U.S. Cl. ..... 116/173; 273/34 R; 116/222

[58] Field of Search ..... 273/34, 32 H, 32 R; 116/173, 174, 175, 222

[56] References Cited

U.S. PATENT DOCUMENTS

| | | | |
|---|---|---|---|
| 3,204,599 | 9/1965 | Milosch | 116/173 |
| 3,240,183 | 3/1966 | Walter et al. | 116/173 |
| 3,302,344 | 2/1967 | Wolfe et al. | 273/32 R |
| 3,983,716 | 10/1976 | Kuhn | 63/1.1 |
| 4,057,030 | 11/1977 | Womack | 116/222 |
| 4,247,994 | 2/1981 | Cullen, Jr. | 273/32 R |

FOREIGN PATENT DOCUMENTS

| | | | |
|---|---|---|---|
| 2076662 | 2/1981 | United Kingdom | 273/32 R |

OTHER PUBLICATIONS

Cosom catalog, 1970, p. 3.

*Primary Examiner*—William A. Cuchlinski, Jr.
*Assistant Examiner*—Jeffrey J. Hohenshell
*Attorney, Agent, or Firm*—Thomas J. Dodd

[57] ABSTRACT

An indicator attached to a golf flagstick to inform golfers as to the depth of the pin on the putting green. The indicator is a one-piece molded part and includes a hinge and a latch to allow the indicator to be quickly shifted by golf course personnel.

5 Claims, 2 Drawing Sheets

FLAGSTICK POSITION INDICATOR

FIELD OF THE INVENTION

This invention relates to a golf flagstick position indicator which provides a golfer with a visual indication of the hole position on the putting green.

BACKGROUND OF THE INVENTION

As noted by numerous well-known golfers and golf writers, the biggest change in the game of golf over the past few years has been "playing by yardage." While golfers of the past had to rely on approximation of yardage along with the "feel" for the correct yardage, today's golfer is helped along by yardage guides either placed on the courses or in yardage books furnished to the golfer prior to beginning the round. Playing by yardage has increased the ease of selecting the proper club for a given shot and has made the game more enjoyable for a large majority of players.

Unfortunately, most courses measure yardage from a given point on the course, say a tree or sprinkler head, as computed to the center of the putting green. Given that many courses, particularly modern ones, are designed with relatively large greens to minimize wear, the yardage tends to become distorted if the hole is located far from the exact center of the green. This distortion can actually harm the average golfer and can cause him to select an improper club, thus defeating the purpose of the yardage markers.

Recently, many golf courses have placed indicators on the flagstick to assist the golfer in determining the location of the hole relative to the center of the putting green. These indicators currently take on two forms, namely a second, smaller flag, or a plastic ball secured to the flagstick. Assuming the flagstick is visible to the golfer from the fairway, the position of the hole is readily ascertained by noting the position of the indicator.

SUMMARY OF THE INVENTION

The indicator of this invention includes a one-piece spherical ball or orb which has two hemispheres joined by an integral hinge. The orb has aligned bores to accommodate the flagstick. Straps or similar holding devices circumscribe the flagstick and hold the orb at a predetermined location in accordance with modern course practice—the higher the orb is positioned on the flagstick, the farther the hole is back in relation to the front edge of the putting green. The orb also includes an integral latch to allow rapid positional changes of the orb by golf course personnel.

Accordingly, it is an object of the present invention to provide for a novel indicator which is placed on a golf flagstick to inform a golfer of the depth of the hole relative to the front edge of the putting green.

Another object is to provide a flagstick indicator which is inexpensive and resistant to theft or vandalism.

Another object of this invention is to provide a one-piece flagstick indicator which may be easily adjusted by golf course personnel.

Other objects of this invention will become apparent upon a reading of the following description.

BRIEF DESCRIPTION OF THE DRAWINGS

A preferred embodiment of the invention has been depicted for illustrative purposes only wherein.

DESCRIPTION OF THE PREFERRED EMBODIMENT

The preferred embodiment herein described is not intended to be exhaustive or to limit the invention to the precise form disclosed. It is chosen and described to explain the principles of the invention and its application and practical use to enable others skilled in the art to utilize the invention.

Figure 1:
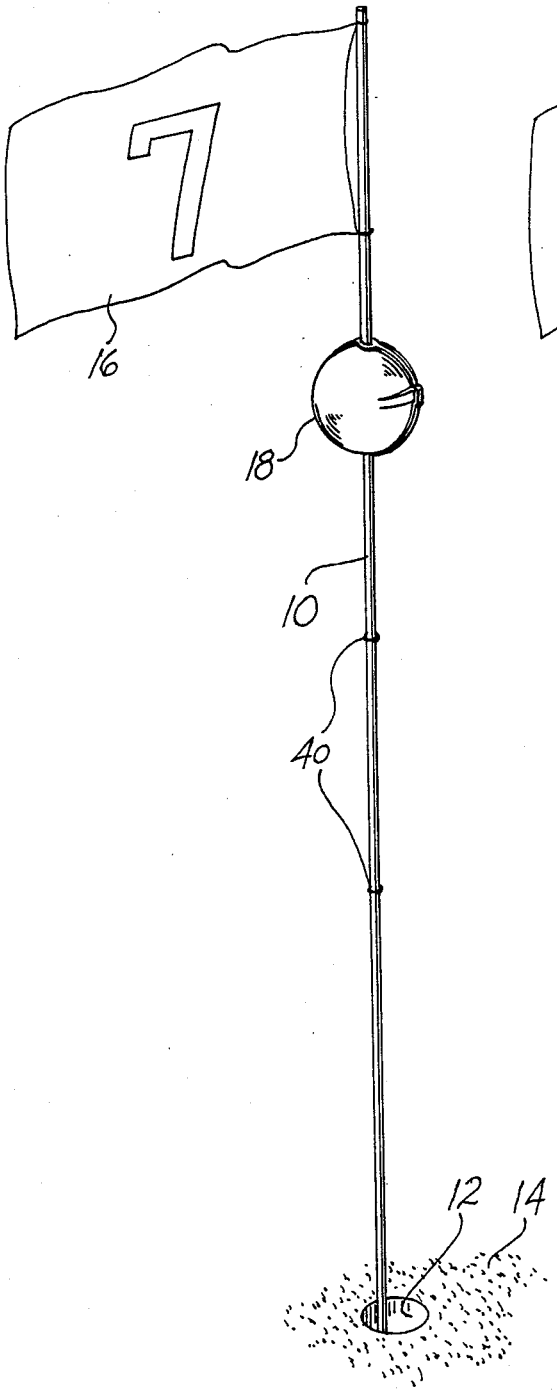
FIG. 1 is a perspective view of a flagstick which employs the indicator of this invention, and illustrating the indicator at its upmost position to designate a cup position towards the back edge of the putting green.
Figure 2:
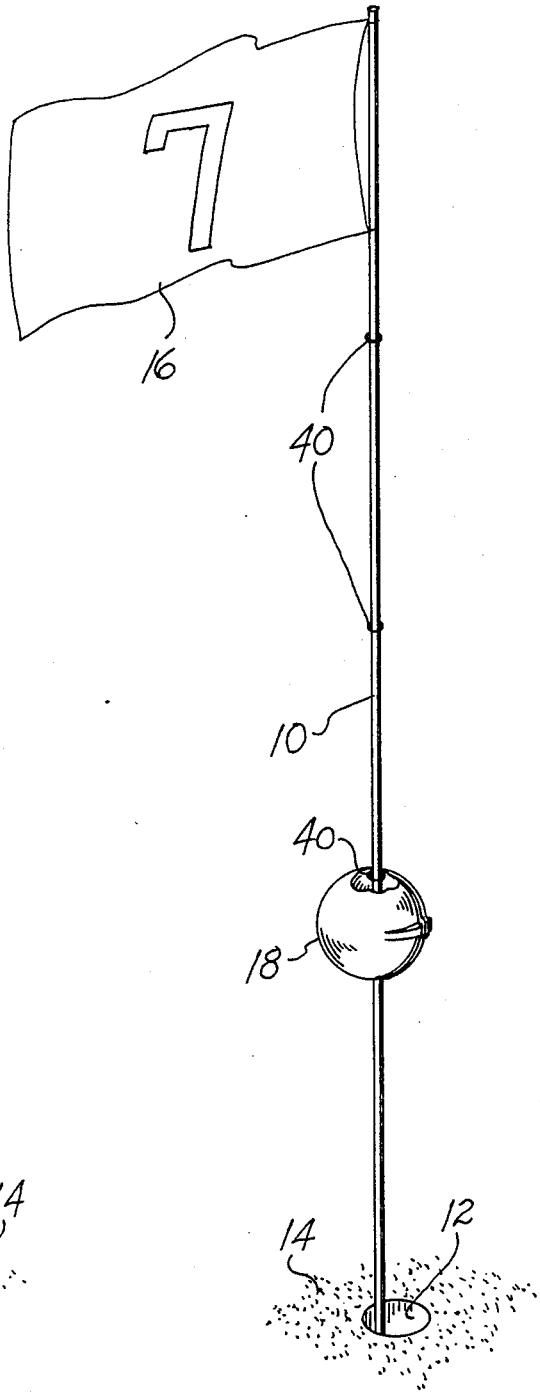
FIG. 2 is a perspective view similar to FIG. 1 but showing the indicator positioned to indicate a cup position near the front edge of the putting green.

Referring now to FIGS. 1 and 2, reference numeral 10 refers generally to a golf flagstick of the type commonly used by modern golf courses. Flagstick 10 includes an elongated rod, usually 6 to 8 feet long which is removably secured within a cup 12 on putting green 14. Flagstick 10 carries attached flat 16 which assists the golfer in sighting of the flagstick from a distance. Since the construction of flagstick 10 and cup 12 and the manner of releasable securement therein is old and well-known, their construction will not be discussed further.

Figure 4:
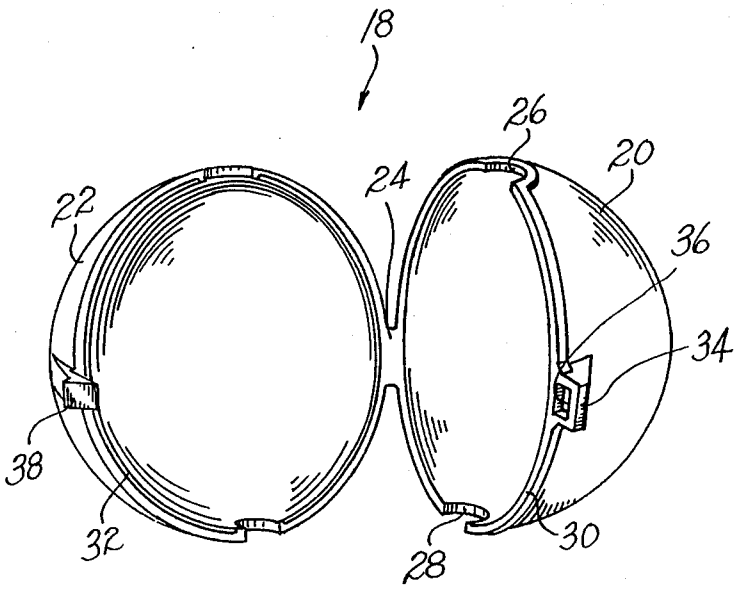
FIG. 4 is a perspective view of the indicator in its open or adjustment position.
Figure 3:
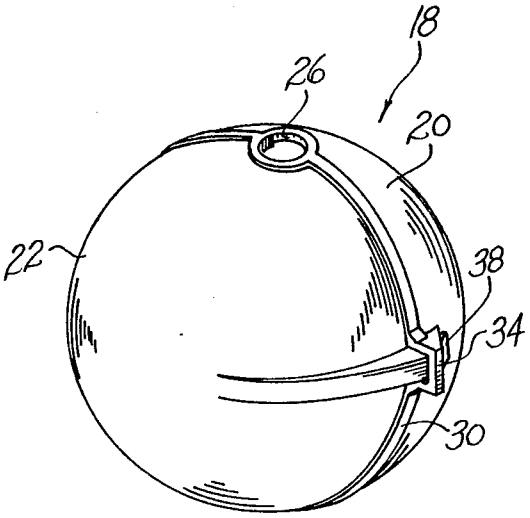
FIG. 3 is a perspective view of the indicator in its closed or operative position.

Reference numeral 18 refers generally to the indicator of this invention shown in FIGS. 1–4. Indicator 18 is a generally spherical one-piece orb preferably formed of a molded durable plastic such as polyurethane and colored so as to be distinguishable from the surroundings. Indicator 18 as shown in FIGS. 3 and 4 includes first and second hemispheres 20, 22 which define aligned bores 26, 28 and are connected by an integral hinge 24 commonly referred to in the trade as a "living" hinge (see FIG. 4). Although indicator 18 is shown as having a hollow interior, other solid interior constructions and plastic compounds are possible without departing from the spirit of the invention.

Hemisphere 20 is formed with an outer circumferential lip portion 30 interrupted by bores 26, 28. Hemisphere 22 is formed with an inner circumferential lip portion 32 to provide support for hinge 24 when indicator 18 is in the closed position of FIGS. 1–3.

Hemisphere 20 also includes an integral projection 34 which defines opening 36 and is spaced approximately equidistantly from bores 26, 28 as shown. Hemisphere 22 also includes a projecting hook part 38 which is aligned with projection opening 36 and serves to latch indicator 18 in the closed orientation.

Indicator 18 is used in conjunction with flagstick 10 as follows. With the cup 12 positioned nearer the back edge of putting green 14, a greenskeeper presses in on hemisphere 22 and slides hook part 38 out of contact with projection 34 until indicator 18 is in the open position of FIG. 4. Bores 26, 28 are aligned with flagstick 10 and indicator 18 is snapped into the closed position of FIGS. 1 and 3 with the hollow center of the indicator concealing a top holding strap 40 shown in FIGS. 1–2. Straps 40 (three are shown) may be of any acceptable form, such as a rubber O-ring, which do not change position once placed on the flagstick 10. The preferred strap 40 for flagsticks already assembled will resemble the strap commonly used to tie trash can liners after filling, namely a rubber or plastic strap with a hole at one end and a plurality of serrated teeth at the other end which are pulled through the hole to firmly secure the strap in place. Because of the well-known nature of this type of strap, details have been omitted from the drawings and specification for the sake of clarity.

Once installed, indicator 18 gives a distant visual indication of the approximate depth of the cup 12 in relation to the center of the putting green 14. In accord with modern golf course practice, positioning the indicator 18 near the top of flagstick 10 (FIG. 1) indicates a back cup 12 placement, bottom positioning (FIG. 2) indicates a front cup placement and center positioning (not shown) indicates a middle of the green placement to allow the golfer who plays by yardage the maximum information necessary to select the proper club for his shot.

It should be understood that the invention is not limited to the details above given, but may be modified within the scope of the following claims.

I claim:

1. An indicator adapted for connection to a golf flagstick to indicate flagstick position on a putting green, said indicator comprising a one-piece orb, said orb having aligned bores to accommodate a golf flagstick and including first and second hemispheres connected by an integral hinge, and an integral latch means for securing said hemispheres together about said golf flagstick, and strap means adapted for securement about said golf flagstick for holding the orb at one of several preselected heights to indicate a depth of said golf flagstick on the putting green.

2. The indicator of claim 1 wherein said latch means includes a hook part integrally formed with said first hemisphere, said second hemisphere including an integral projection having an opening aligned with said hook part, said hook part shiftable between a locked position mating with said projection to lock the hemispheres together, and an unlocked position spaced from said projection wherein the orb may be removed from the flagstick for repositioning.

3. The indicator of claim 2 wherein said orb is formed entirely of a moldable plastic material.

4. In combination, a golf flagstick and a depth indicator, said flagstick including an elongated rod adapted to carry a flag and to be removably secured within a buried cup on a golf putting green, said depth indicator including a one-piece orb having first and second hemispheres hingedly connected to each other by an integral hinge part, and means for latching said hemispheres in a closed configuration about said flagstick, wherein placement of the indicator at a predetermined height on said flagstick provides a distant visual indication of the location of said cup with respect to a front and back edge of the putting green, and strap means secured to the flagstick for holding said orb at its said predetermined height.

5. The combination of claim 4 wherein said latch means includes a hook part integrally formed with said first hemisphere, said second hemisphere including an integral projection having an opening aligned with said hook part, said hook part shiftable between a locked position mating with said projection to lock the hemispheres together, and an unlocked position spaced from said projection wherein the orb may be removed from the flagstick for repositioning.

* * * * *